US008763961B1

(12) United States Patent
Yang

(10) Patent No.: US 8,763,961 B1
(45) Date of Patent: Jul. 1, 2014

(54) AUTOMATIC LOCKING GUITAR HOLDING RACK

(71) Applicant: Reliance International Corp., Taipei (TW)

(72) Inventor: Bean Yang, Taipei (TW)

(73) Assignee: Reliance International Corp, Taipei (TW)

( * ) Notice: Subject to any disclaimer, the term of this patent is extended or adjusted under 35 U.S.C. 154(b) by 0 days.

(21) Appl. No.: 13/724,139

(22) Filed: Dec. 21, 2012

(51) Int. Cl.
*G10G 5/00* (2006.01)

(52) U.S. Cl.
USPC ..... 248/122.1; 248/176.1; 84/327

(58) Field of Classification Search
USPC ..... 248/188.1, 188.91, 188.8, 121, 122.1, 248/176.1, 124.2, 124.1; 84/327, 453
See application file for complete search history.

(56) References Cited

U.S. PATENT DOCUMENTS

| | | | | |
|---|---|---|---|---|
| 6,513,768 | B1 * | 2/2003 | Hsieh | 248/121 |
| 7,423,209 | B2 * | 9/2008 | Chen | 84/327 |
| 7,547,835 | B1 * | 6/2009 | Mayor | 84/327 |
| 2003/0173484 | A1 * | 9/2003 | Hsieh | 248/291.1 |
| 2006/0213351 | A1 * | 9/2006 | Hsieh | 84/327 |
| 2010/0163693 | A1 * | 7/2010 | Wang | 248/121 |
| 2010/0181441 | A1 * | 7/2010 | Yu | 248/121 |
| 2011/0303804 | A1 * | 12/2011 | Rodrigues | 248/122.1 |

FOREIGN PATENT DOCUMENTS

| | | | |
|---|---|---|---|
| CN | 201084394 | Y | 7/2008 |
| CN | 201199432 | Y | 2/2009 |
| TW | 486132 | | 6/2001 |
| TW | M274611 | | 1/2005 |
| TW | I300550 | | 10/2006 |
| WO | WO-2011/137666 | A1 | 11/2011 |

* cited by examiner

*Primary Examiner* — Steven Marsh
(74) *Attorney, Agent, or Firm* — Muncy, Geissler, Olds & Lowe, P.C.

(57) ABSTRACT

An automatic locking guitar holding rack comprises a brace arm, a first movable lock device and a second movable lock device separated from the first movable lock device. The first movable lock device has a first movement portion located on the first holding section, and the second movable lock device has a second movement portion on the second holding section. The first and second movement portions are separated. The first movable lock device is depressible by the head of a guitar to move a first actuation member in a first compression displacement to drive a first confining member to proceed a first swivel displacement. The second movable lock device is depressible by the head of the guitar to move a second actuation member in a second compression displacement to drive a second confining member to proceed a second swivel displacement.

13 Claims, 6 Drawing Sheets

AUTOMATIC LOCKING GUITAR HOLDING RACK

FIELD OF THE INVENTION

The present invention relates to an automatic locking guitar holding rack and particularly to a guitar holding rack equipped with a brace arm to hold two movable lock devices which move independently.

BACKGROUND OF THE INVENTION

At present the methods of holding and storing guitars after performances mainly can be divided into two types: one is holding the guitar in a chest or casing in a sealed manner to provide desired protection, another is holding the guitar via a holding rack. The holding rack has at least one brace arm. In addition to holding the guitar, it also serves exhibition function. Many types of holding racks have been proposed in prior art, such as R.O.C. patent Nos. 486132, M274611 and I300550, China patent Nos. CN201084394 and CN201199432, and International intellectual right organization gazette No. WO2011137666. They mostly have an upper rack to hold the neck of a guitar and a lower rack to hold the guitar body. The upper rack usually has a first brace arm and a second brace arm to form a holding zone between them to hold the neck of the guitar. In order to hold the guitar securely in the holding zone the holding rack generally has a locking structure to switch the holding zone in a locking state or a release state.

The locking structure of the holding rack generally is interlocking, such as R.O.C. patents M274611, I300550 and 486132, China patent CN201199432 and WO2011137666. They usually have an interactive structure added to the holding rack to form a locking structure on a first brace arm and a second brace arm that are movable relative to each other. The interactive structure generally consists of more complex mechanical elements that make fabrication and assembly of the holding rack more difficult.

SUMMARY OF THE INVENTION

The primary object of the present invention is to overcome the problem of the conventional guitar holding racks caused by the locking structure.

To achieve the foregoing object the invention provides an automatic locking guitar holding rack which comprises a brace arm, a first movable lock device and a second movable lock device. The brace arm includes a first holding section and a second holding section spaced from the first holding section in a parallel manner to form a containing space between them to hold the neck of a guitar. The first movable lock device is located on the first holding section and includes a first actuation member depressible by the head of the guitar to move in a first compression displacement and a first confining member hinged on the first holding section and driven by one end of the first actuation member in the first compression displacement to proceed a first swivel displacement axially about the first holding section towards the containing space. The first actuation member includes a first movement portion connected to another end of the first confining member. The second movable lock device is located on the second holding section and includes a second actuation member depressible by the head of the guitar to move in a second compression displacement and a second confining member hinged on the second holding section and driven by one end of the second actuation member in the second compression displacement to proceed a second swivel displacement axially about the second holding section towards the containing space. The second actuation member includes a second movement portion connected to another end of the second confining member. The first and second movement portions are separated.

In one embodiment the first confining member includes a first track opposing the first actuation member, and the first actuation member has a first butting portion in the first track to press the first confining member to proceed the first swivel displacement in the first compression displacement. Similarly, the second confining member also has a second track opposing the second actuation member, and the second actuation member has a second butting portion in the second track to press the second confining member to proceed the second swivel displacement in the second compression displacement.

In another embodiment the first actuation member has a first housing trough to cover the first holding section; more specifically, the first actuation member has a first rolling ball held in the first housing trough in contact with the first holding section. Similarly, the second actuation member has a second housing trough to cover the second holding section, and also a second rolling ball held in the second housing trough in contact with the second holding section.

In yet another embodiment the brace arm includes a first elastic element on the first holding section to butt on the first actuation member. Similarly, the brace arm also includes a second elastic element on the second holding section to butt on the second actuation member.

In yet another embodiment the first actuation member has a first elastic buffer in contact with the neck of the guitar, and the second actuation member also has a second elastic buffer in contact with the neck of the guitar.

In yet another embodiment the brace arm has a first extension section connected to the first holding section and extended to the containing space and hinged on the first confining member; similarly, the brace arm also has a second extension section connected to the second holding section and extended to the containing space and hinged on the second confining member.

In yet another embodiment the brace arm has a connecting section connecting to the first holding section and second holding section.

In yet another embodiment the brace arm has a bridge member at another end opposite to the containing space to couple with an upright support post.

By means of the structure set forth above, compared with the conventional guitar holding racks, the invention provides many advantages, notably:

The two holding sections can be locked independently. The first holding section and second holding section have respectively the first movable lock device and second movable lock device that are separated and moved independently, and are depressible by the head of the guitar for locking to confine the guitar in the containing space.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
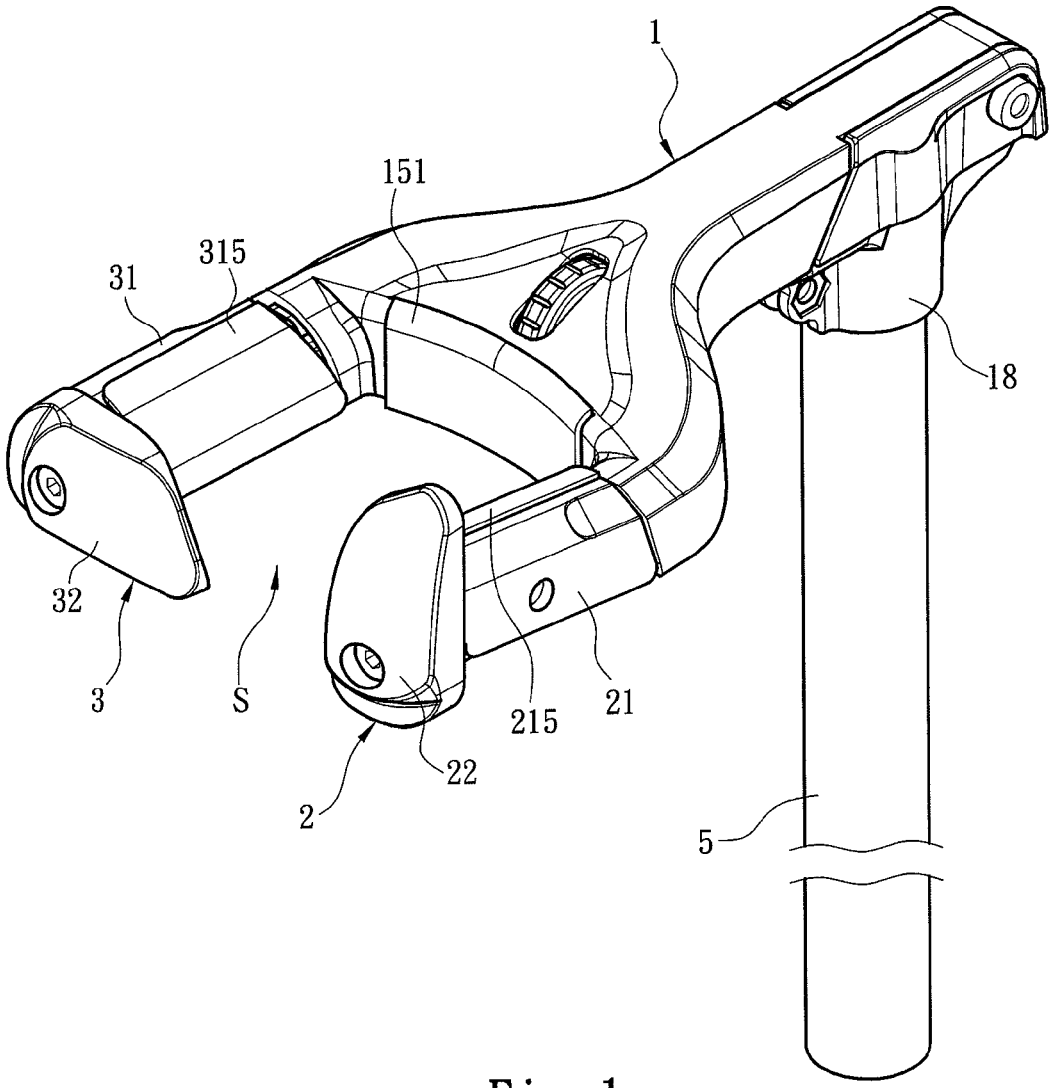
FIG. 1 is a perspective view of an embodiment of the automatic locking guitar holding rack of the invention.
Figure 2:
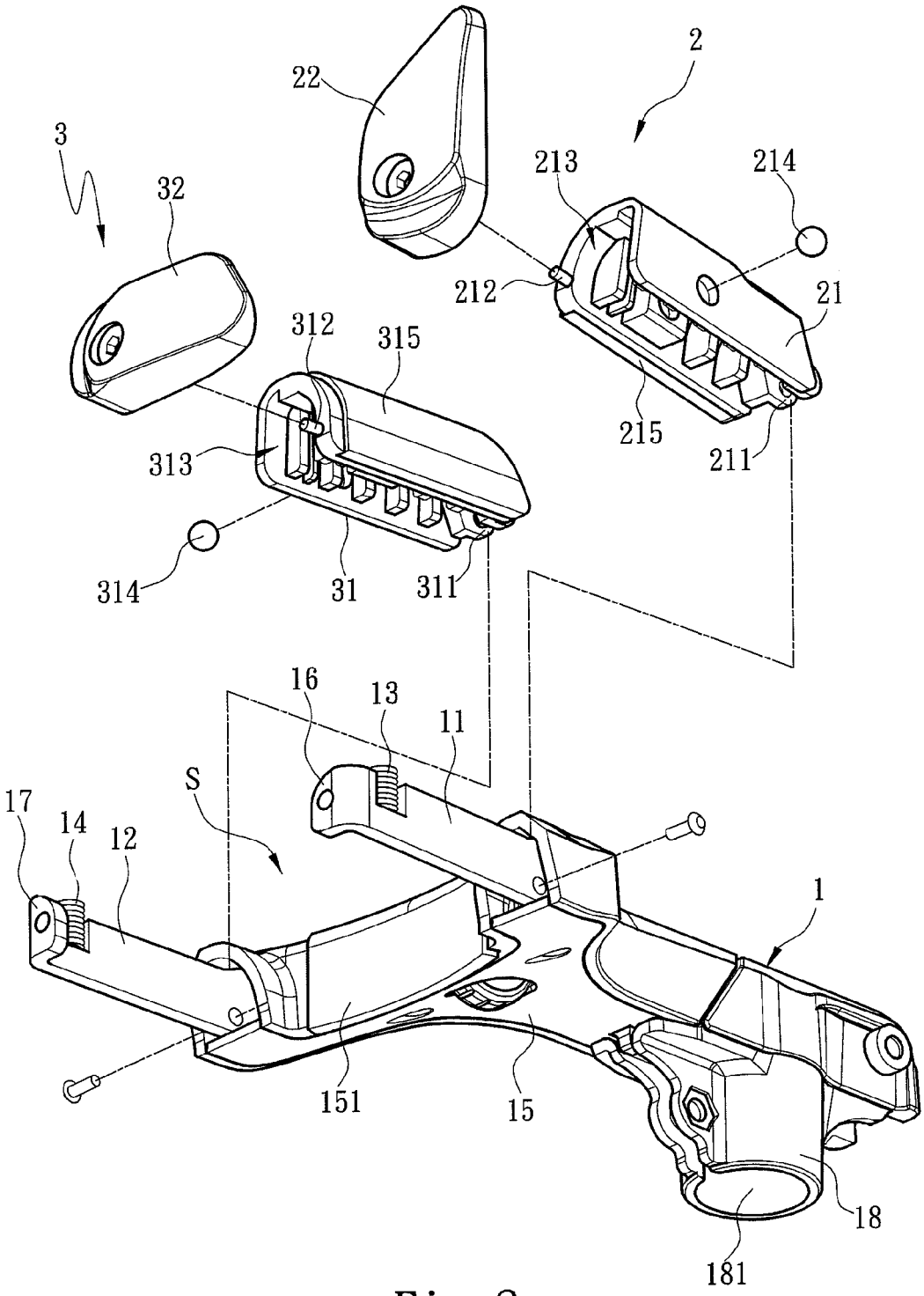
FIG. 2 is an exploded view of an embodiment of the invention.
Figure 3:
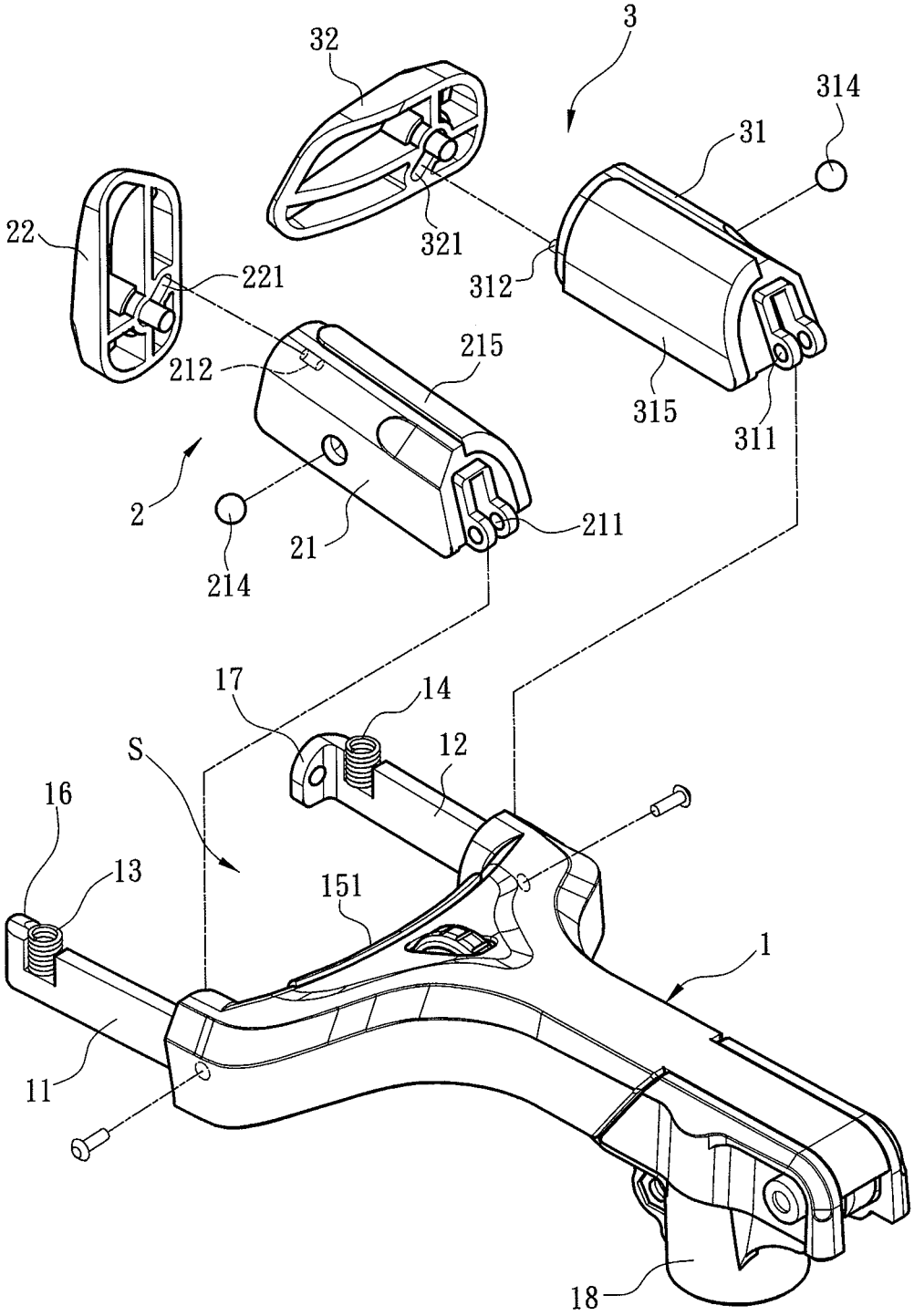
FIG. 3 is another exploded view of an embodiment of the invention seen from another angle.

Please referring to FIGS. 1, 2 and 3, the present invention aims to provide an automatic locking guitar holding rack. It comprises a brace arm 1, a first movable lock device 2 and a second movable lock device 3. The brace arm 1 can be an upper holding section of the guitar holding rack to hold the neck (not shown in the drawings) of a guitar 4. The brace arm 1 includes a first holding section 11 and a second holding section 12 spaced from the first holding section 11 in a parallel manner to form a containing space S between them to hold the neck of the guitar. The first movable lock device 2 is located on the first holding section 11 and includes a first actuation member 21 and a first confining member 22 hinged on the first holding section 11 and driven by the first actuation member 21. The first actuation member 21 has a first movement portion 211 connecting to another end thereof opposite to the first confining member 22. More specifically, the first movement portion 211 is located on the first holding section 11. When to receive the guitar is intended, the first actuation member 21 is pressed by the head of the guitar and moves in a first compression displacement, and the first confining member 22 is driven by one end of the actuation member 21 in the first compression displacement to proceed a first swivel displacement axially about the first holding section 11 towards the containing space S, thereby can confine the guitar from escaping the containing space S through the first confining member 22. The second movable lock device 3 is eventually constructed same as the first movable lock device 2, but is located on the second holding section 12 and includes a second actuation member 31 and a second confining member 32 hinged on the second holding section 12 and driven by the second actuation member 31. The second actuation member 31 has a second movement portion 311 connecting to another end thereof opposite to the second confining member 32. The second movement portion 311 and first movement portion 211 are separated. Namely, the first and second movable lock devices 2 and 3 are separately located on the first and second holding sections 11 and 12. In addition, the second actuation member 31 also is depressible by the head of the guitar to move in a second compression displacement, and the second confining member 32 is driven by the second actuation member 31 in the second compression displacement to proceed a second swivel displacement axially about the second holding section 12 towards the containing space S. Thereby the second confining member 32 also can confine the guitar from escaping the containing space S.

Figure 4A:
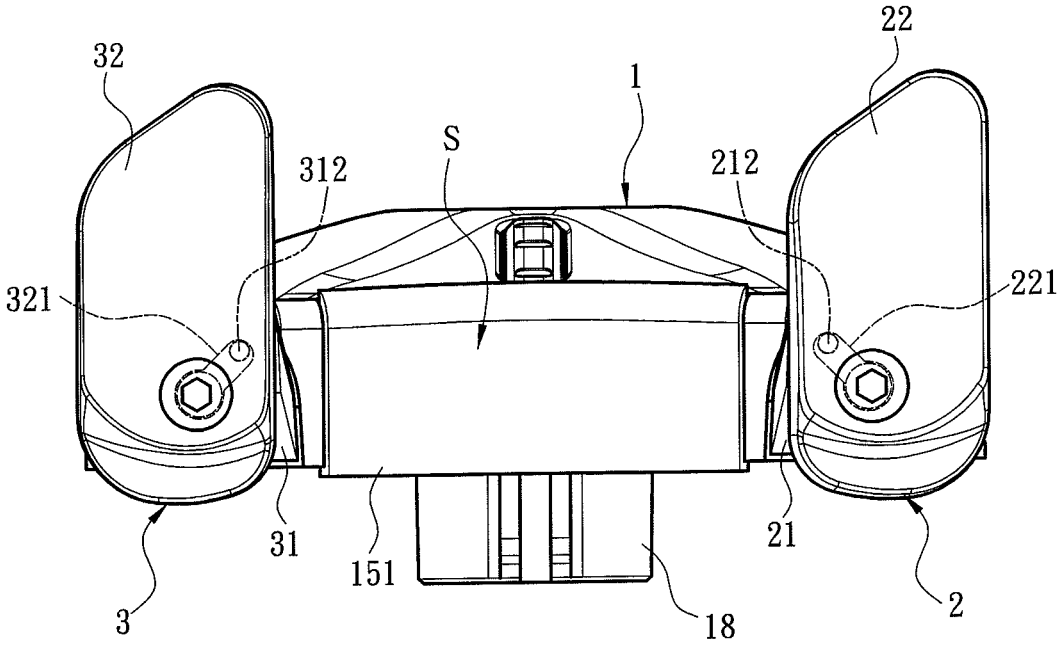
FIG. 4A is a schematic view of an embodiment of the invention in locking condition-1.
Figure 4C:
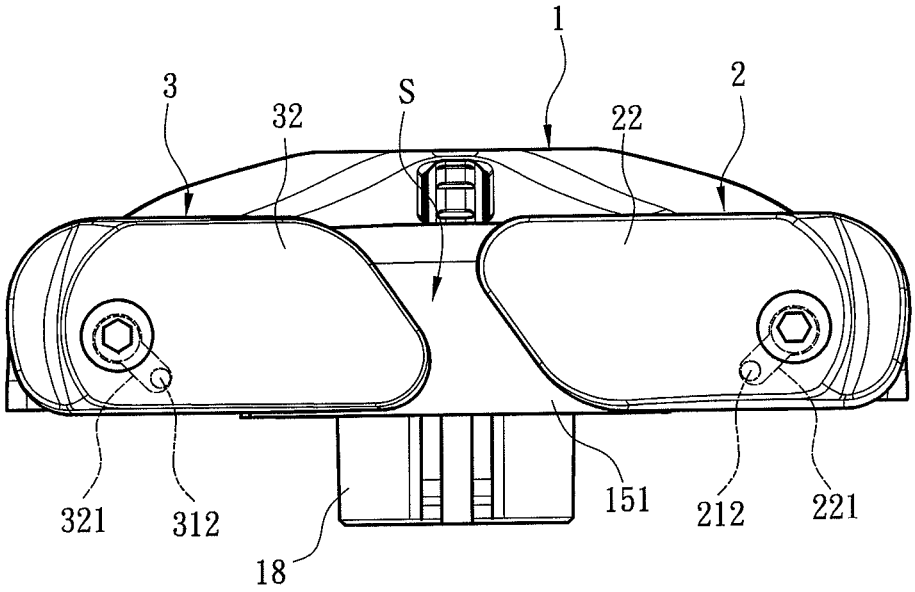
FIG. 4C is a schematic view of an embodiment of the invention in locking condition-3.
Figure 4B:
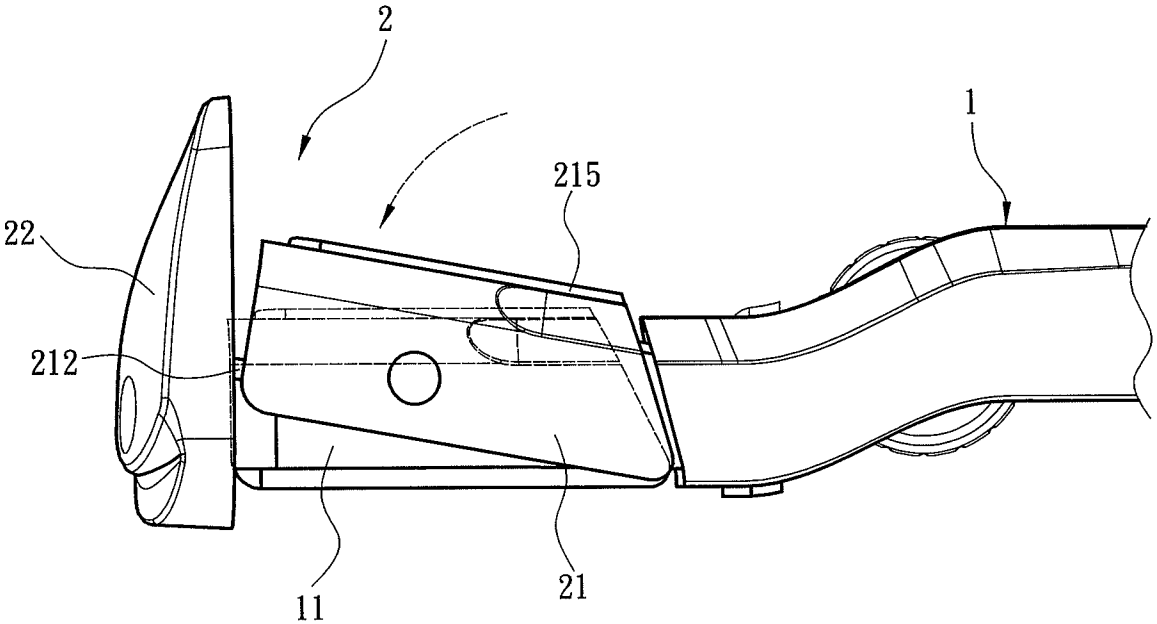
FIG. 4B is a schematic view of an embodiment of the invention in locking condition-2.
Figure 5:
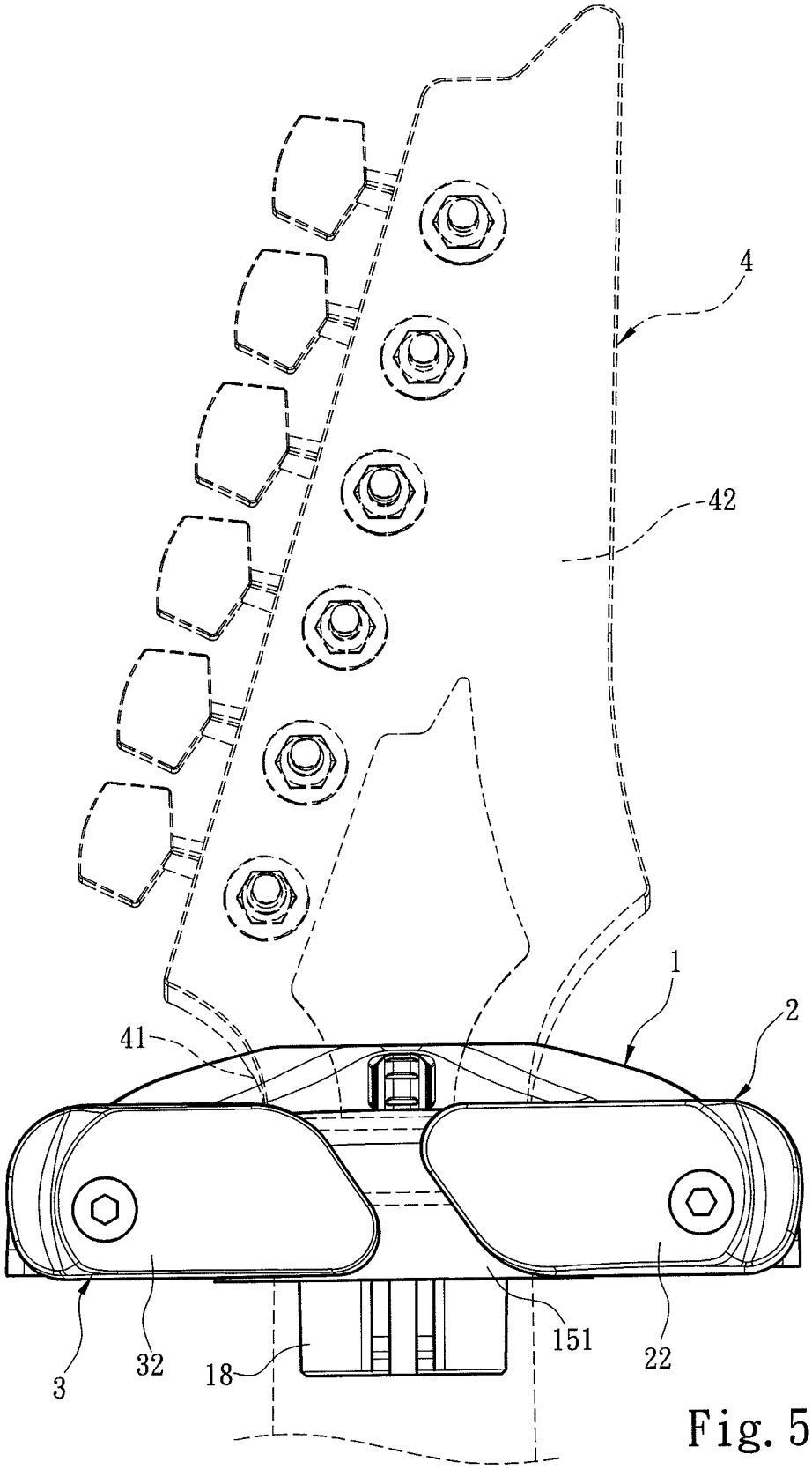
FIG. 5 is a schematic view of an embodiment of the invention for holding a guitar.

Please refer to FIGS. 4A through 4C and 5 for implementation of the invention. FIG. 4A illustrates the guitar holding rack in a normal condition without holding the guitar 4. The first actuation member 21 is suspended on the first holding section 11 through the first movement portion 211 as a fulcrum, and the first confining member 22 is not driven by the first actuation member 21; the first holding section 11 is not moved towards the containing space S in the normal condition. The second actuation member 31, like the first actuation member 21, also is suspended on the second holding section 12 through the second movement portion 311 as a fulcrum, and the second confining member 32 also is not driven to move towards the containing space S. When holding the guitar 4 is desired, the neck 41 of the guitar 4 is placed into the containing space S, the head 42 of the guitar presses the first and second actuation members 21 and 31 to move in the first and second compression displacements, and also drive the first and second confining members 22 and 32 in the first and second swivel displacements towards the containing space S to form a locking state to confine the guitar 4 from escaping the containing space S as shown in FIG. 5. When removing the guitar 4 is desired, push the neck 41 against the first and second actuation members 21 and 31 to proceed the first and second compression displacement in the reverse direction, the first and second confining members 22 and 23 are moved outwards from the containing space S, then the locking condition is released and the guitar 4 can be removed as desired.

Please also refer to FIGS. 2 and 3 for more details of the guitar holding rack of the invention. The first confining member 22 has a first track 221 on one side coupled with the first actuation member 21. The first actuation member 21 has a first butting portion 212 located in the first track 221. The first butting portion 212 butts the first confining member 22 via the first track 221 as a press spot in the first compression displacement to proceed the first swivel displacement. Similarly, the confining member 32 also has a second track 321, and the second actuation member 31 has a second butting portion 312. The second butting portion 312 also functions like the first butting portion 212 in the first track 221 as discussed previously, thus details are omitted. Moreover, the first actuation member 21 has a first holding trough 213 to cover the first holding section 11 after the first compression displacement, and the first actuation member 21 further has a first rolling ball 214 held in the first holding trough 213. The first rolling ball 214 is in contact with the first holding section 11 to reduce the frictional force while the first actuation member 21 proceeds the first compression displacement. Similarly, the second actuation member 31 also has a second holding trough 313 to cover the second holding section 12 after the second compression displacement, and the second holding trough 313 also has a second rolling ball 314 to reduce the frictional force. Aside from the first and second rolling balls 214 and 314 to reduce the frictional forces in the first and second compression displacements, the brace arm 1 further has a first elastic element 13 on the first holding section 11 opposing the first actuation member 21. The first elastic element 13 has one end located on the first holding section 11 and another end butting on the first actuation member 21 to provide a return force to return the first actuation member 21 to a normal condition. The brace arm 1 also can have a second elastic element 14 located on the second holding section 12 butting on the second actuation member 31 to generate the same effect as the first elastic element 13 does. Also referring to FIGS. 1 and 5, to prevent the guitar 4 from being damaged due to holding, the first actuation member 21 can have a first elastic buffer 215 in contact with the neck 41 of the guitar 4; similarly, the second actuation member 31 also can have a second elastic buffer 315 in contact with the neck 41.

Furthermore, the brace arm 1 can have a connecting section 15 connected to the first holding section 11 and second holding section 12. The connecting section 15 is butted by the neck 41 of the guitar 4 after the guitar 4 is held on the holding rack. The connecting section 15 can have a third elastic buffer 151 to avoid damaging the guitar 4. In addition, the brace arm 1 has a first extension section 16 connected to the first holding section 11 and extended towards the containing space S, and the first confining member 22 can be located on the first extension section 16. The brace arm 1 also can have a second extension section 17 connected to the second holding section 12 and extended towards the containing space S.

Similarly, the second confining member 32 also can be located on the second extension section 17. Furthermore, the brace arm 1 also can have a bridge member 18 at another end opposite to the containing space S. The bridge member 18 has a fastening portion 181 to couple on an upright support post 5. Thus the guitar holding rack can hold guitars of varying sizes through the upright support post 5.

As a conclusion, the automatic locking guitar holding rack of the invention provides the first movable lock device with a first movement portion located on the first holding section, and the second movable lock device with a second movement portion located on the second holding section, and the first and second movement portions are separated. When in use to hold a guitar, the first movable lock device is pressed by the head of the guitar so that the first actuation member is moved in the first compression displacement to drive the first confining member to proceed the first swivel displacement about the first holding section as an axis, and the second movable lock device also is pressed by the head of the guitar so that the second actuation member is moved in the second compression displacement to drive the second confining member to proceed the second swivel displacement about the second holding section as an axis, thereby the two arms can lock independently to overcome the problem occurred to the conventional guitar holding racks.

While the preferred embodiments of the invention have been set forth for the purpose of disclosure, they are not the limitation of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An automatic locking guitar holding rack, comprising:

a brace arm including a first holding section and a second holding section spaced from the first holding section in a parallel manner to form a containing space to hold the neck of a guitar;

a first movable lock device which is located on the first holding section and includes a first actuation member depressible by the head of the guitar in a first compression displacement and a first confining member hinged on the first holding section and driven by one end of the first actuation member, when the first actuation member proceeding the first compression displacement the first holding section rotating towards the containing space to proceed a first swivel displacement, the first actuation member containing a first movement portion connecting to another end of the first actuation member opposite to the first confining member; and a second movable lock device which is located on the second holding section and includes a second actuation member depressible by the head of the guitar in a second compression displacement and a second confining member hinged on the second holding section and driven by one end of the second actuation member, when the second actuation member proceeding the second compression displacement the second holding section rotating towards the containing space to proceed a second swivel displacement, the second actuation member containing a second movement portion connecting to another end of the second actuation member opposite to the second confining member, the first movement portion and the second movement portion being separated;

wherein the first confining member includes a first track corresponding the first actuation member, the first actuation member including a first butting portion located in the first track to press the first confining member in the first compression displacement to proceed the first swivel displacement; and wherein the second confining member includes a second track corresponding the second actuation member, the second actuation member including a second butting portion located in the second track to press the second confining member in the second compression displacement to proceed the second swivel displacement.

2. The automatic locking guitar holding rack of claim 1, wherein the first actuation member includes a first housing trough to cover the first holding section.

3. The automatic locking guitar holding rack of claim 2, wherein the first actuation member includes a first rolling ball located in the first housing trough in contact with the first holding section.

4. The automatic locking guitar holding rack of claim 1, wherein the second actuation member includes a second housing trough to cover the second holding section.

5. The automatic locking guitar holding rack of claim 4, wherein the second actuation member includes a second rolling ball located in the second housing trough in contact with the second holding section.

6. The automatic locking guitar holding rack of claim 1, wherein the brace arm includes a first elastic element on the first holding section butting on the first actuation member.

7. The automatic locking guitar holding rack of claim 1, wherein the brace arm includes a second elastic element on the second holding section butting on the second actuation member.

8. The automatic locking guitar holding rack of claim 1, wherein the first actuation member includes a first elastic buffer in contact with the neck of the guitar.

9. The automatic locking guitar holding rack of claim 1, wherein the second actuation member includes a second elastic buffer in contact with the neck of the guitar.

10. The automatic locking guitar holding rack of claim 1, wherein the brace arm includes a first extension section connected to the first holding section and extended into the containing space and hinged on the first confining member.

11. The automatic locking guitar holding rack of claim 1, wherein the brace arm includes a second extension section connected to the second holding section and extended into the containing space and hinged on the second confining member.

12. The automatic locking guitar holding rack of claim 1, wherein the brace arm includes a connecting section connected to the first holding section and the second holding section to be butted by the neck of the guitar.

13. The automatic locking guitar holding rack of claim 1, wherein the brace arm includes a bridge member at another end opposite to the containing space to couple with an upright support post.

* * * * *